United States Patent [19]

Maughan et al.

[11] Patent Number: 4,630,736

[45] Date of Patent: Dec. 23, 1986

[54] SORTING MACHINE UTILIZING AN IMPROVED LIGHT DETECTION SYSTEM

[75] Inventors: William S. Maughan, West Sussex; Herbert Fraenkel, London, both of England

[73] Assignee: Sortex Limited, London, England

[21] Appl. No.: 621,253

[22] Filed: Jun. 15, 1984

[30] Foreign Application Priority Data

Jun. 30, 1983 [GB] United Kingdom ..... 8317777

[51] Int. Cl.[4] ..... B07C 5/342

[52] U.S. Cl. ..... 209/587; 209/581; 209/585; 209/639

[58] Field of Search ..... 209/576–578, 209/580, 581, 585, 587, 588, 639

[56] References Cited

U.S. PATENT DOCUMENTS

| | | | |
|---|---|---|---|
| 2,131,095 | 9/1938 | Cox | 209/581 X |
| 2,971,646 | 2/1961 | Coffey | 209/587 X |
| 3,738,484 | 6/1973 | Hoover et al. | 209/581 |
| 3,776,381 | 12/1973 | Wood | 209/581 X |
| 4,096,949 | 6/1978 | Hoover et al. | 209/581 X |

FOREIGN PATENT DOCUMENTS

| | | | |
|---|---|---|---|
| 0044014 | 1/1982 | European Pat. Off. | 209/581 |
| 0964432 | 7/1964 | United Kingdom . | |
| 2072835A | 10/1981 | United Kingdom . | |

*Primary Examiner*—Robert B. Reeves
*Assistant Examiner*—Edward M. Wacyra
*Attorney, Agent, or Firm*—Cushman, Darby & Cushman

[57] ABSTRACT

A sorting machine comprising a chute for moving a plurality of objects sequentially past a plurality of viewing zones which are spaced apart in the direction of movement of the objects so that the moving objects pass to an object separation zone in which relative separation is effected between desired and undesired objects. Light sources are on opposite sides of the moving object for directing beams of light to the viewing zones. Viewing devices view the objects passing through the viewing zones from opposite sides, respectively, of the moving objects. A discriminator, controlled by the output from the viewing devices, determines whether objects which have been so viewed are desired or undesired. An object separator controlled by the discriminator effects relative separation at the object separation zone between the desired and undesired objects. The viewing devices and light sources are so arranged that at least most of the light which is reflected by an object so as to be directed into a viewing device is derived from a light source disposed on the same side of the moving objects as the respective viewing devices.

25 Claims, 5 Drawing Figures

SORTING MACHINE UTILIZING AN IMPROVED LIGHT DETECTION SYSTEM

Figure 1:
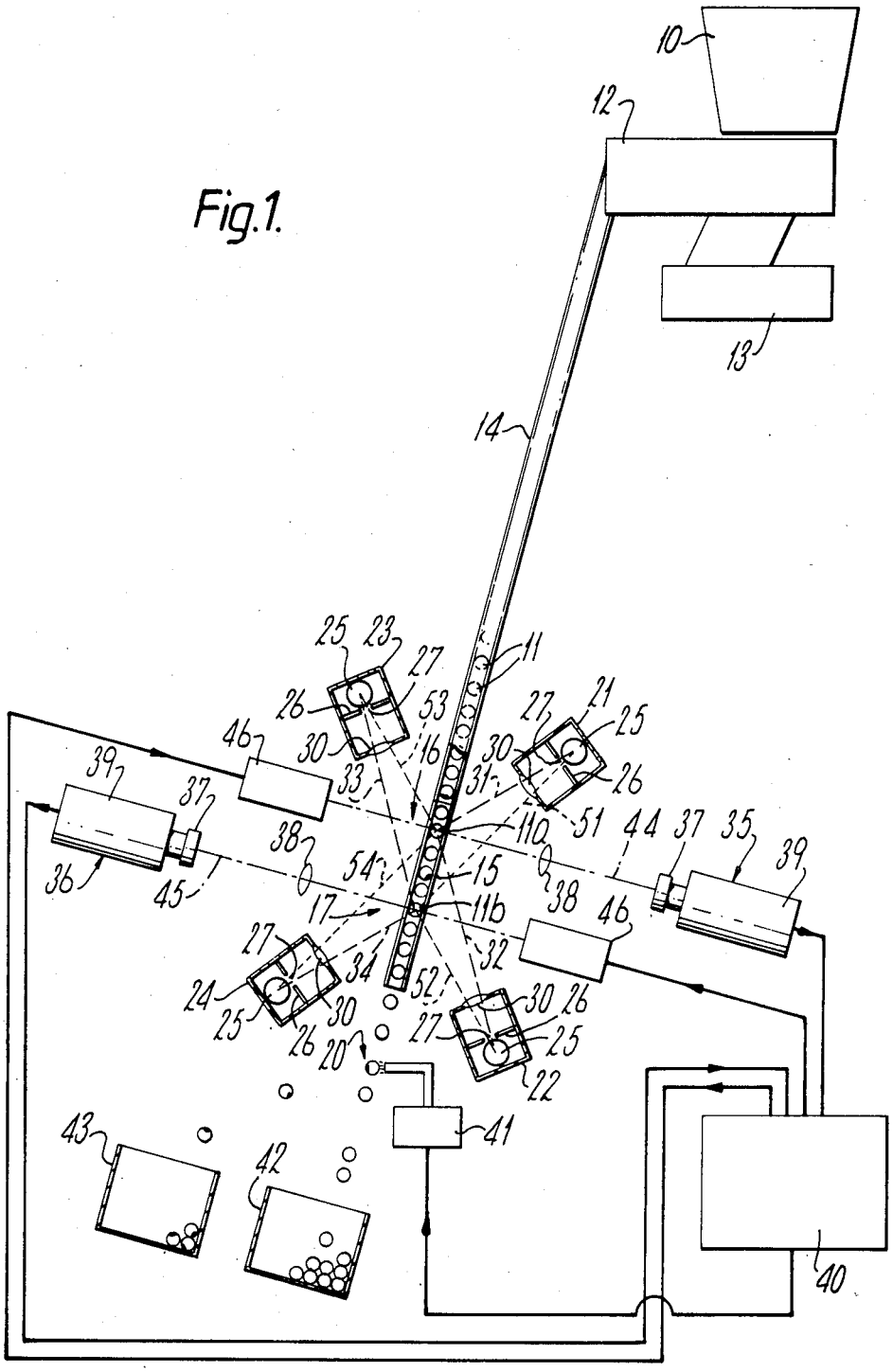

The present invention concerns sorting machines and although the invention is not so restricted it more particularly concerns sorting machines which observe the light reflected from the surface of objects in order to effect sorting in dependence upon the colour or reflectivity of the objects.

Such machines are commonly used in the processing of agricultural produce, such as rice, coffee and beans, and also in the purification of minerals, either in the form of streams of fine particles or in the form of lumps of ore.

A sorting machine is often arranged to view an object simultaneously through several lenses. The reason for this is that a small discolouration, or defect, may only be visible over a restricted range of viewing angles. Common configurations are:

'three sided' viewing where the object is observed simultaneously by three lenses arranged around the object at angular intervals of approximately 120°, and 'two sided' viewing where the object is observed simultaneously from opposite sides.

The latter configuration is often used where a sorting machine consists of several sorting channels arranged in close proximity to make a compact machine.

An advantage of viewing simultaneously from several different directions is that the signals from each viewing direction, which determine whether or not an ejector is to be operated so as to remove an undesired object from a stream of objects being viewed, may simply be combined. The ejector is spaced from the viewing area and the signals from the latter are therefore transmitted to the ejector after a delay which corresponds to the time taken for the undesired object to travel from the viewing area to the ejector. Thus, in the case of viewing simultaneously from several different directions, there is the advantage that each signal from the viewing area needs to be delayed to the same extent before being transmitted to the ejector.

However, simultaneous viewing from several directions requires that the object to be sorted must be illuminated on all sides. This requirement has a serious disadvantage. The diffusely reflected light, which it is desirable that a viewing system receive is scattered at the surface of the object. This diffusely reflected light contains the information concerning reflectivity and colour upon which the operation of the sorting machine is based. However, when the object to be sorted (e.g. a coffee bean) has a smooth surface, there will be specular reflections in addition to the diffusely reflected light. Specular reflections from the front of the object being viewed are not a great problem since they do not normally form a very high proportion of the light being viewed. However, specular reflections are a particular problem when illumination from the rear of the object strikes the edge of the object at glancing incidence.

Such specular reflections, at glancing incidence, may constitute most (e.g. 90%) of the light being viewed and since they are often strong in intensity and have different colour characteristics from the light which is reflected diffusely from the surface of the object, they may seriously affect the accuracy of the sorting action of the machine.

It is already known that, where two sided viewing is employed, plane polarised light may be use as a partial solution to the problem of specular reflection. However, the use of polarised illumination is limited in that there may be no more than two orthogonal viewing systems and it also has a number of practical disadvantages in that the process of plane polarisation causes the loss of at least 50% of the incident light; precise alignment of polarising elements is difficult both to set up initially and to maintain in the presence of dust and moisture contamination; and where illumination is derived from a distributed light source (e.g. a fluorescent tube), no single flat polarising element will produce the correct polarisation across the full width of the light source.

According to the present invention, there is provided a sorting machine comprising means for moving a plurality of objects sequentially past a plurality of viewing zones which are spaced apart in the direction of movement of the objects so that the moving objects pass to an object separation zone in which relative separation is effected between desired and undesired objects; light sources on opposite sides of said moving objects for directing beams of light to said viewing zones; viewing means for effecting viewing of the objects passing through the viewing zones, from opposite sides respectively of said moving objects, discriminator means, controlled by the output from said viewing means, for determining whether objects which have been so viewed are desired or undesired; and object separation means, controlled by said discriminator means, for effecting relative separation in the object separation zone between said desired and undesired objects, characterised in that said viewing means and light sources are so arranged that at least most of the light which is reflected by an object so as to be directed into a viewing means is derived from a light source disposed on the same side of the said moving objects as the respective viewing means.

By reason of the said arrangement of the viewing means and light sources, the problem arising from specular reflections at glancing incidence is overcome.

Preferably, the objects which move past the viewing zones are in the form of a plurality of objects which are disposed side by side in a plane. Thus the objects may be arranged either in a random stream of objects disposed in said plane or in a plurality of separate rows of objects disposed in said plane.

Each of the light sources preferably extends parallel to said plane so as to illuminate said side by side objects.

Preferably, the beams from light sources on opposite sides of the moving objects illuminate different viewing zones, there being no substantial overlap of said beams in any viewing zone.

The objects may be arranged to be moved horizontally, e.g. they may be carried on a transparent horizontally moving belt or they may be entrained in a fluid through a transparent horizontal conduit. In this case, the viewing zones will be horizontally spaced apart. Preferably, however, the moving objects are falling under gravity, the viewing zones being respectively one above the other, and the separation zone being beneath the viewing zone.

The light is preferably fluorescent light.

Each beam of light is preferably substantially focussed in its respective viewing zone. Thus, in the case of free-fall sorting, it should desirably be focussed to the degree that is necessary to obtain an uniform area of illumination both in height and depth sufficient to cover the natural variations of trajectory of the objects passing through the viewing zones.

Preferably, the angle between at least one of the beams and the optical axis of the respective viewing means is not less than 40°.

Preferably at least 80%, and if desired substantially all, of the light which is reflected by an object so as to be directed into a viewing means is derived from a light source disposed on the same side of the said moving objects as the respective viewing means.

Each light source preferably produces a beam which is out of alignment with any viewing means on either side of the moving objects. The said beam is preferably substantially parallel to that produced by a light source on the opposite side of the moving objects.

In one embodiment of the invention, each light source also produces a second beam which is directed to a viewing zone different to that illuminated by the first-mentioned beam, the second beam being less powerful than the firstmentioned beam. In this case, each light source may be provided with an aperture plate having different apertured portions for respectively producing the first-mentioned beam and the second beam. Moreover, filter means may be provided for rendering the second beam less powerful than the first-mentioned beam.

Each light source preferably has a lens associated therewith through which in operation passes the or each beam produced by the light source, the lens substantially focussing the or each respective beam onto an object in the respective viewing zone. Each such lens may be a Fresnel lens.

Each viewing means preferably effects viewing in a direction substantially normal to that in which the moving objects pass.

There may be a transparent duct through which the objects pass. The trasnparent duct may, for example, be formed by two spaced apart sheets of transparent material. The transparent duct may, moreover, be at an angle of 10° to 20° to the vertical.

Each viewing zone may be lit by two light sources which are disposed on opposite sides of the respective line of view.

Preferably the or each beam which is produced by each light source and substantially focussed by each lens cannot be reflected by the transparent duct into the respective viewing means.

Each light source may be arranged to direct its beam or beams of light onto a mirror which reflects the said beam or beams to the viewing zones.

The invention also comprises a method of sorting comprising moving a plurality of objects sequentially past a plurality of spaced apart viewing zones so that the moving objects pass to an object separation zone in which relative separation is effected between desired and undesired objects; employing light sources on opposite sides of said moving objects to direct beams of light to said viewing zones; employing viewing means to effect viewing of the objects passing through the viewing zones from opposite sides respectively of said moving objects; employing discriminator means controlled by said viewing means, to determine whether objects which have been so viewed are desired or undesired; and employing object separation means, controlled by said discriminator means to effect relative separation in the object separation zone between said desired and undesired objects, characterised by arranging said viewing means and light sources so that at least most of the light which is reflected by an object so as to be directed into a viewing means is derived from a light source disposed on the same side of the said moving objects as the respective viewing means.

In one particular form of the said method, the objects are opaque, the viewing means and the light sources being so arranged that substantially any light which is reflected by an object so as to be directed into a viewing means is derived from a light source disposed on the same side of the said moving objects as the respective viewing means.

In another form of the said method the objects are translucent, each light source also producing a second beam which is directed to a viewing zone different to that illuminated by the first-mentioned beam, the second beam being less powerful than the first-mentioned beam, the arrangement being such that each viewing means receives a major amount of reflected light which is reflected by an object and is derived from a light source disposed on the same side of the moving objects as the respective viewing means, and a minor amount of transmitted light which is transmitted through the object and is derived from a light source disposed on the opposite side of the moving objects.

Figure 2:
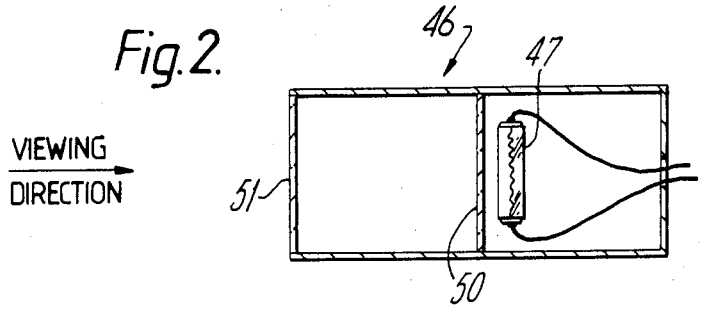
Figure 3:
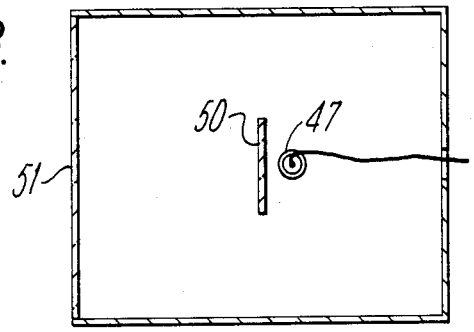
Figure 4:
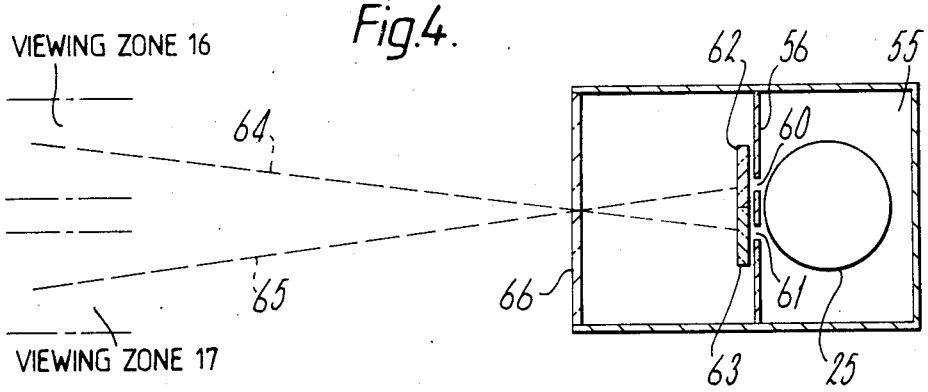
Figure 5:
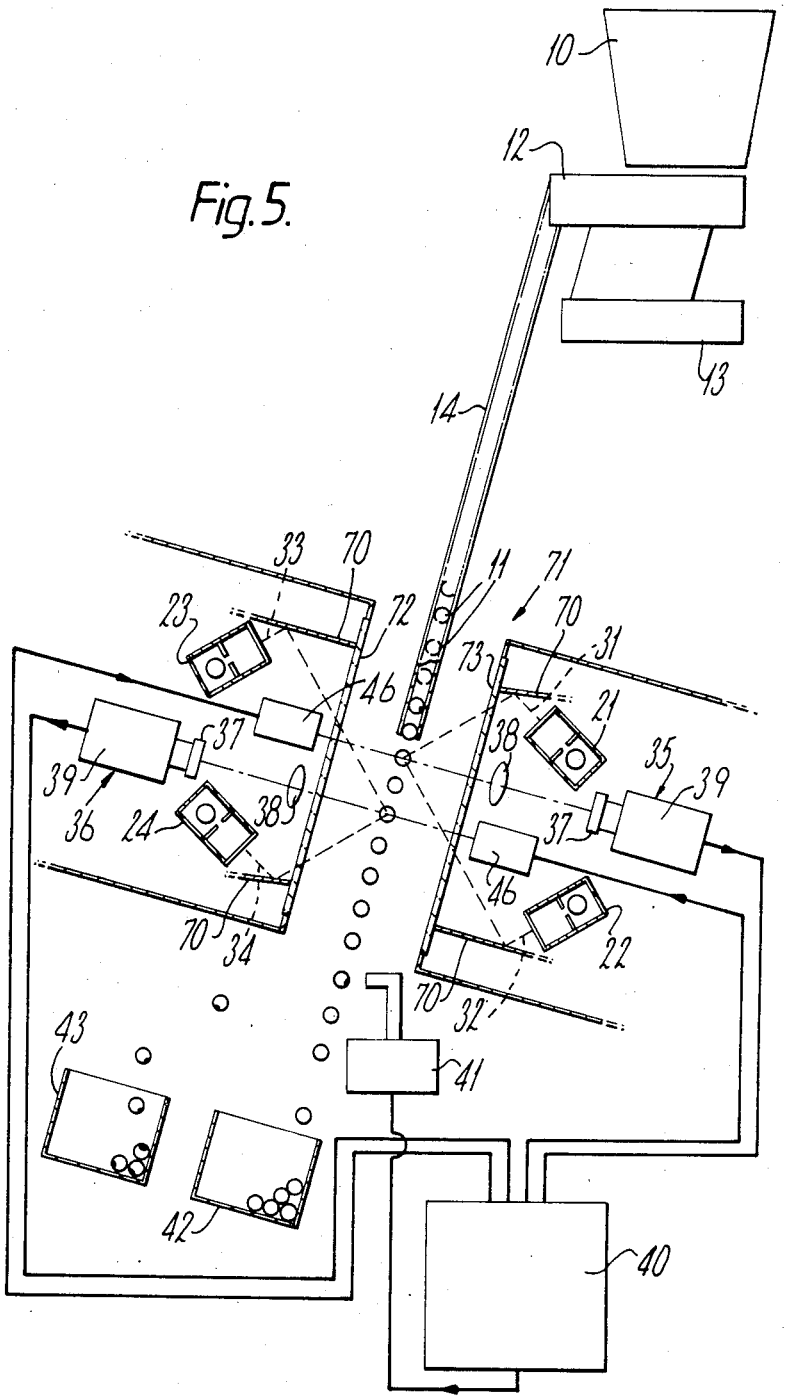

The invention is illustrated, merely by way of example, in the accompanying drawings, in which:

FIG. 1 is a diagrammatic view of a first embodiment of a sorting machine according to the present invention, FIGS. 2 and 3 are respectively a plan view and an elevation of a background unit forming part of the sorting machine of FIG. 1, FIG. 4 illustrates a lighting unit which may be employed in the sorting machine of FIG. 1, and FIG. 5 is a diagrammatic view of a second embodiment of a sorting machine according to the present invention.

Referring first to FIG. 1, a sorting machine according to the present invention comprises a hopper 10 adapted to contain objects 11 to be sorted. Such objects may, for example, be agricultural products such as peas, beans (e.g. coffee beans), nuts, diced potatoes and rice, or mineral products, such as diamonds and other precious stones and pieces of ore. The term "objects" is used herein in a wide sense so as, for example, to include particulate material. Objects 11 in the hopper 10 may pass to a tray 12 which is, in operation, vibrated by a vibrator 13 so as to cause the objects 11 to pass, one at a time, to a chute or duct 14 which is disposed at an angle within the range of 10° to 20° (e.g. 15°) to the vertical. The chute or duct 14 may be formed of a material having a low coefficient of friction such as anodised aluminium and may be aligned with a chute or duct 15 of similar diameter which is formed of a transparent material such as glass or methyl methacrylate. Alternatively, the successive chutes 14, 15 may be replaced by a single transparent chute, or the chute 15 may be omitted.

The objects 11, which slide under gravity down the chutes 14, 15 travel sequentially past an upper viewing zone 16 and a lower viewing zone 17 so that the moving objects 11 pass to an object separation zone 20 which is disposed beneath the viewing zones 16, 17. In the object separation zone 20 relative separation is effected between desired and undesired objects, e.g. between those which have and those which do not have a predetermined colour or between those which have and do not have a predetermined fluorescence. The upper and lower viewing zones 16, 17 may, for example, be spaced apart by 1" (2.54 cms).

Lighting of the upper viewing zone 16 is effected by two lighting units 21, 22 which are disposed on the right hand side of the chutes 14, 15 and thus of the moving objects 11. Similarly, lighting of the lower viewing zone 17 is effected by two lighting units 23, 24 which are disposed on the left hand side of the chutes 14, 15 and thus on the opposite side of the moving objects 11. Each of the lighting units 21–24 comprise a fluorescent tube or other light source 25, and aperture plate 26 having an aperture 27 therein and a lens 30. The term "light" is used in this specification in a wide sense to include both visible and non-visible radiation, such as infra-red and ultra-violet radiation. The lighting units 21, 22 thus produce substantially collimated beams of light 31, 32 respectively which are substantially focussed by the respective lenses 30 onto an object 11*a* in the upper viewing zone 16. Similarly, the lighting units 23, 24 produce substantially collimated beams of light 33, 34 which are substantially focussed by the respective lenses 30 onto an object 11*b* in the lower viewing zone 17. The lenses 30 may be constituted by plastic Fresnel lenses. The beams 31, 34 on opposite sides of the path of the moving objects are parallel to each other, while the beams 32, 33 are similarly parallel to each other.

The upper and lower viewing zones 16, 17 respectively have upper and lower viewing means 35, 36 associated therewith, the viewing means 35, 36 respectively effecting viewing of the objects 11*a*, 11*b* passing through the upper and lower viewing zones 16, 17 from opposite sides respectively of the moving objects. Each of the viewing means 35, 36 comprises a photo-electric detector 37 which views the objects 11*a*, 11*b* through a respective lens (or lens tube) 38. The electrical output of each detector 37 is amplified in a DC coupled pre-amplifier 39 and passes to a processor 40. The processor 40 is programmed so that, under the control of the output from the viewing means 35, 36, it determines whether objects 11 which have been viewed by the viewing means 35, 36 are desired or undesired. when an undesired object 11 is detected, e.g. an object which has a discoloured area, the processor 40 produces an output signal which is transmitted to effect opening of a valve (not shown) in an air ejector 41, whereby a jet of compressed air is directed onto the undesired object, when the latter reaches the separation zone 20. Thus desired objects pass undeflected to an "accept" container 42 while undesired objects are deflected into a "reject" container 43.

As will be seen from FIG. 1, each of the beams 31-34 is out of alignment with any viewing means 35, 36 on either side of the path of the moving objects 11. The angle between each of the beams 31–34 and the optical axis or line of view 44, 45 of the respective viewing means 35, 36 is preferably not less than 40°, each said optical axis 44, 45 being substantially normal to the path of the moving objects 11. Each viewing zone 16, 17 is thus lit by two light sources 25 which are disposed on opposite sides of the respective optical axis 44, 45.

In the construction so far, substantially any light which is reflected by an object 11 so as to be directed into a viewing means 35, 36 is derived from a light source 25 which is disposed on the same side of the path of the moving objects as the respective viewing means. For example, the "front" of the object 11*a* receives light from the beams 31, 32 and reflects this light so that it can be viewed by the photo-electric detector 37 of the viewing means 35. The disposition of the beams 31, 32 is such that comparatively little specular reflection from the object 11*a* is directed through the respective lens 38 onto the respective photo-electric detector 37, whereby the reflected light received by the photo-electric detector is primarily constituted by diffuse reflection from the front of the object 11*a*. The beams 33, 34 from the lighting units 23, 24 do not illuminate the "rear" of the object 11*a* and consequently there is no danger of these beams 33, 34 producing glancing specular reflection which will be directed onto the respective photo-electric detector 37. Furthermore, the beams 31, 32 will not enter the viewing means 36, while the beams 33, 34 will not enter the viewing means 35. Thus in the construction described above, absolutely no light, whether specular or diffused, reflected by the object or transmitted through the object, from a light source 25 on one side of the path of the objects 11 will enter a lens or lens tube 38 on the other side thereof.

The provision of the apertures 27 and lenses 30 of the lighting units 21, 22 produce pyramid-like beams of light 31, 32 which are substantially focussed onto the object 11*a* so that they do not illuinate the object 11*b*. Similarly, the beams 33, 34 illuminate the object 11*b* without illuminating the object 11*a*. The beams of light 31–34 are focused to the degree that is necessary to obtain a uniform area of illumination both in height and depth sufficient to cover the natural variations in the trajectory of the objects 11 passing through the viewing zones.

It will be noted that the beams 31–34 are at "steep" angles so as to effect good top and bottom lighting of the objects being viewed. For example, and previously mentioned, the angle between each of the beams 31–34 and the respective optical axis 44, 45 is preferably at least 40°. The optimum value of this angle is 45°. However a value of 42° may be adopted so as to reduce the size of the optical box (not shown) which includes the viewing means 35, 36 and so as to produce an illumination "diamond" which is greater in width than in height. The importance of this feature is that if good top and bottom lighting of the objects being viewed is not provided, a signal will be produced as each object enters and leaves a viewing zone. In that case, it may be difficult to recognise a signal produced by a small discoloured area of an object being viewed since the latter signal may be smaller than the entry and exit signals.

Each of the viewing means 35, 36 views the objects against a background 46 whose colour or reflectivity is arranged to be as similar as possible to that of the average of the "good" objects. The use of the backgrounds 46 compensates for variations in the sizes of the objects 11. As shown in FIGS. 2 and 3, each background 46 is lit by a filament bulb 47 having a baffle 50 in front of it. Light from the filament bulb is directed onto a translucent window 51 which is viewed by the respective viewing means 35, 36, the baffle 50 ensuring that the translucent window 51 is diffusely lit. The colour of the translucent window 51 is matched to that of the average of the "good" objects The brightness of each background 46 is controlled by the processor 40, which adjusts the voltage of the electrical supply to the background 46 so that, as described in greater detail in European Patent Specification No. 0 056 513. A2, the brightness of each background is adjusted when necessary by the processor 40 so that the background remains appropriate at all times to the objects being viewed.

The lighting of the backgrounds illustrated in FIGS. 2 and 3 does not produce stray illumination which would be viewed by the viewing means 35, 36 so as to adversely affect the accuracy of the sorting.

Although one particular method of lighting the background is illustrated in FIGS. 2 and 3, many other methods are possible which may involve either transmitted or reflected light.

Although FIG. 1 shows one single sorting channel, the sorting machine would in practice have a large number of sorting channels arranged side by side, each channel having its respective chutes 14, 15, lighting units 21–24, viewing means 35, 36, ejector 41 and backgrounds 46. However, all the sorting channels would have one common processor 40 which, would, inter alia, control the individual backgrounds 46 so that these would not necessarily all be at the same brightness. Thus such variation in brightness of the backgrounds 46 may be necessary if the light sources 25 were constituted by fluorescent tubes extending throughout all the channels, since the light output of such fluorescent tubes is not constant throughout the length of the tubes.

As will be appreciated, in the arrangement described in the previous paragraph, the objects 11 which move past the viewing zones 16, 17 are in the form of a plurality of objects which are disposed side by side in a plane. As described in the previous paragraph, these objects may be arranged in a plurality of separate rows of objects disposed in said plane. Alternatively, however, the objects may be arranged in a random stream of objects disposed in said plane. In either case, the light sources employed, e.g. the said fluorescent tubes or lines of light-emitting diodes, may extend parallel to said plane so as to illuminate said side by side objects.

By reason of the vertical spacing apart of the viewing zones 16, 17, the signals received by the processor 40 from the viewing means 35, 36 of each channel will need to be delayed to different extents before being transmitted to the respective ejector 41. However, the processor 40 may readily be programmed so that the signal from the upper viewing zone 16 will, after a suitable interval, be combined with that from the lower viewing zone 17 to produce a single accept/reject signal.

As so far described, the sorting machine of FIG. 1 is suitable primarily for sorting opaque objects such as coffee beans, in which case the viewing means 35, 36 will merely view light reflected by the opaque objects. In the case of some translucent objects such as rice, however, it may be desirable for the viewing means to view both such reflected light and also light transmitted through the translucent objects. For example, if one is sorting parboiled rice some of whose grains are partially covered by husk, it is difficult to remove the husk-covered grains if use is made only of reflected light since the colour and reflectivity of the husk does not greatly differ from that of the rice itself. However, the husk is opaque so that, if back lighting is employed, light will not be transmitted through the husk and the husk-covered grains can easily be detected and removed.

In order to be able to effect such back lighting, each of the lighting units 21–24 is able to produce not only the above-mentioned beams 31–34 but also beams 51–54. Thus each light source 25 produces a beam 51–54 which is directed to a viewing zone 16, 17 different to that illuminated by the respective beams 31–34, the beams 51–54 being arranged, as described below, to be less powerful than the beams 31–34. For example. the light source 25 of the lighting unit 21 will produce the beam 31 which is directed to the upper viewing zone 16 and the beam 51 which is directed to the lower viewing zone 17. The beams 51–54 will illuminate the rear of the translucent objects 11 and this illumination will be transmitted through the translucent objects 11 so that both this transmitted light and the light which is reflected by the translucent objects will be viewed by the viewing means 35, 36. There may, of course, be some glancing specular reflection produced by the beams 51–54 but, by making the beams 51–54 less powerful than the beams 31–34, it may be arranged that, say, at least 80% of the light which is reflected by an object so as to be directed into a viewing means is derived from a light source disposed on the same side of the said moving objects as the respective viewing means.

Thus a lighting unit 55 may be used as shown in FIG. 4 which comprises an aperture plate 56 having two apertures 60, 61 therein. Behind the aperture plate 56, i.e. on the side thereof remote from the light source 25, filters 62, 63 are provided. Filtered beams 64, 65 (corresponding, for example, to the beams 31, 51) are produced which are substantially focussed by a common Fresnel or other lens 66. By appropriate selection of the filters 62, 63 it may be arranged that the beam 65 is less powerful than the beam 64 so that each viewing means 35, 36 receives a major amount of reflected light which is reflected by an object and is derived from a light source disposed on the same side of the moving objects as the respective viewing means, and a minor amount of transmitted light which is transmitted through the object and is derived from a light source disposed on the opposite side of the moving objects. The beam 65 may also be made less powerful than the beam 64 by appropriate selection of the sizes of the apertures 60, 61. If desired, the filters 62, 63 may differ from each other in optical density and/or in colour.

In FIG. 5 there is shown a sorting machine which is generally similar to that of FIG. 1 and which for this reason will not be described in detail, like reference numerals indicating like parts. In the FIG. 5 construction, however, the beams 31–34 from the lighting units 21–24 are directed to the respective viewing zones by way of mirrors 70, whereby the size of the optical box or system 71 may be minimised whilst still providing the best angle of illumination.

Moreover, instead of providing a transparent chute or duct 15, the objects 11 falling from the lower end of the chute or duct 14 pass through a transparent duct formed by two spaced apart parallel flat sheets or windows 72, 73 of glass or other transparent material. The optical components may thus be sealed from contamination by the dust entrained with the objects 11. The windows 72, 73 may be easily cleaned.

Parallel glass windows have in the past given rise to the risk that reflection from the surface of the glass may enter the viewing means and so "swamp" the sorting signal and the risk that light scattered from dust on the surface of the glass may affect the sorting signals. However, these problems will not arise in the construction illustrated in FIG. 5 since the illumination beams are so positioned that the light reflected from the surface of the glass will not enter the viewing lenses 38. Similarly, the illumination beams are positioned such that no light falls upon the area of glass which is directly in front of the viewing lens.

What is claimed is:

1. A sorting machine comprising:

means for moving a plurality of objects sequentially past a plurality of viewing zones which are spaced apart in the direction of movement of the objects so that the moving objects pass to an object separation zone in which relative separation is effected between desired and undesired objects;

light sources on opposite sides of said moving objects, each light source directing first and second beams of light to different viewing zones respectively;

viewing means for effecting viewing from opposite sides of the objects passing through the viewing zones, each of said first beams being out of alignment with any viewing means on either side of the moving objects, and each of said second beams being directed to a viewing zone different to that illuminated by the respective first beams and being less powerful than the latter;

discriminator means, controlled by the output from said viewing means, for determining whether objects which have been so viewed are desired or undesired; and object separation means, controlled by said discriminator means, for effecting relative separation in the object separation zone between said desired and undesired objects, at least most of the light which is reflected by an object so as to be directed into a viewing means being derived from a light source disposed on the same side of said moving objects as the respective viewing means.

2. A sorting machine as claimed in claim 1 in which the objects which move past the viewing zones are in the form of a plurality of objects which are disposed side by side in a plane.

3. A sorting machine as claimed in claim 2 in which the objects are arranged in a random stream of objects disposed in said plane.

4. A sorting machine as claimed in claim 2 in which the objects are arranged in a plurality of separate rows of objects disposed in said plane.

5. A sorting machine as claimed in claim 2, claim 3 or claim 4 in which each of the light sources extends parallel to said plane so as to illuminate said side by side objects.

6. A sorting machine as claimed in claim 1 in which the first beams from light sources on opposite sides of the moving objects illuminate different viewing zones, there being no substantial overlap of said first beams in any viewing zone.

7. A sorting machine as claimed in claim 1 in which the moving objects are falling under gravity, the viewing zones being respectively one above the other, and the separation zone being beneath the viewing zones.

8. A sorting machine as claimed in claim 1 in which the light is fluorescent light.

9. A sorting machine as claimed in claim 1 in which the angle between at least one of the first beams and the optical axis of the respective viewing means is not less than 40°.

10. A sorting machine as claimed in claim 1 in which at least 80% of the light which is reflected by an object so as to be directed into a viewing means is derived from a light source disposed on the same side of the said moving objects as the respective viewing means.

11. A sorting machine as claimed in claim 1 in which each said first beam is substantially parallel to that produced by a light source on the opposite side of the moving objects.

12. A sorting machine as claimed in claim 1 in which each light source is provided with an aperture plate having different apertured portions for respectively producing the first beam and the second beam.

13. A sorting machine as claimed in claim 12 comprising filter means for rendering the second beam less powerful than the first beam.

14. A method of sorting comprising;

moving a plurality of translucent objects sequentially past a plurality of viewing zones which are spaced apart in the direction of movement of the objects so that the moving objects pass to an object separation zone in which relative separation is effected between desired and undesired objects;

employing light sources on opposite sides of said moving objects, each light source directing first and second beams of light to different viewing zones respectively;

employing viewing means to effect viewing from opposite sides of the objects passing through the viewing zones;

each said second beam being directed to a viewing zone different to that illuminated by each first beam, each second beam being less powerful than each first beam;

employing discriminator means, controlled by said viewing means, to determine whether objects which have been so viewed are desired or undesired; and employing object separation means, controlled by said discriminator means to effect relative separation in the oject separation zone between said desired and undesired objects, each viewing means receiving a major amount of reflected light which is reflected by an object and which is derived from a light source disposed on the same side of the moving objects as the respective viewing means, and a minor amount of transmitted light which is transmitted through the object and is derived from a light source disposed on the opposite side of the moving objects.

15. A sorting machine comprising:

means permitting a plurality of objects to fall sequentially under gravity past a plurality of viewing zones which are spaced apart and respectively disposed one above the other so that the falling objects pass to an object separaton zone which is disposed beneath the viewing zones and in which relative separation is effected between desired and undesired objects;

light sources on opposite sides of said moving objects, each light source directing first and second beams of light to different viewing zones respectively, each second beam being less powerful than each first beam, each beam of light being at an angle to the optical axis of respective viewing means of at least 40°;

viewing means for effecting viewing, from opposite sides, of objects passing through the viewing zones;

discriminator means, controlled by the output from said viewing means, for determinig whether objects which have been so viewed are desired or undesired; and object separation means, controlled by said discriminator means, for effecting relative separation in the object separation zone between said desired and undesired objects, at least most of the light which is reflected by an object so as to be directed into a viewing means being derived from a light source disposed on the same side of said moving objects as the respective viewing means.

16. A sorting machine as claimed in claim 15 in which each beam of light is substantially focussed in its respective viewing zone.

17. A sorting machine as claimed in claim 15 in which each light source has a lens associated therewith through which in operation passes a beam produced by the respective light source, the lens substantially focussing the respective beam onto an object in the respective viewing zone.

18. A sorting machine as claimed in claim 17 in which each lens is a Fresnel lens.

19. A sorting machine as claimed in claim 17 in which each viewing zone is lit by two light sources which are disposed on opposite sides of the respective line of view.

20. A sorting machine as claimed in claim 19 in which there is a transparent duct through which the objects pass, the beam which is produced by each light source and substantially focussed by each lens being incapable of being reflected by said transparent duct into the respective veiwing means.

21. A sorting machine as claimed in claim 15 in which each viewing means effects viewing in a direction substantially normal to that in which the moving objects pass.

22. A sorting machine as claimed in claim 15 comprising a transparent duct through which the objects pass.

23. A sorting machine as claimed in claim 22 in which the transparent duct is formed by two spaced apart sheets of transparent material.

24. A sorting machine as claimed in claim 15 comprising a transparent duct through which the objects pass, the transparent duct being disposed at an angle of 10° to 20° to the vertical.

25. A sorting machine as claimed in claim 15 in which each light source is arranged to direct its light onto a mirror which reflects the said light to the viewing zones.

* * * * *